US008091148B2

(12) United States Patent
Ho

(10) Patent No.: US 8,091,148 B2
(45) Date of Patent: Jan. 10, 2012

(54) FIXING STRUCTURE FOR SAFETY HELMET FASTENING STRAP

(76) Inventor: Chang-Hsien Ho, Taoyuan County (TW)

( * ) Notice: Subject to any disclaimer, the term of this patent is extended or adjusted under 35 U.S.C. 154(b) by 305 days.

(21) Appl. No.: 12/453,252

(22) Filed: May 5, 2009

(65) Prior Publication Data

US 2010/0281603 A1 Nov. 11, 2010

(51) Int. Cl.
*A42B 3/00* (2006.01)

(52) U.S. Cl. ..... 2/411; 2/412; 2/417; 2/421; 2/410; 2/425

(58) Field of Classification Search ..... 2/410, 411, 2/421, 412, 417, 425; D29/102, 104
See application file for complete search history.

(56) References Cited

U.S. PATENT DOCUMENTS

| | | | | |
|---|---|---|---|---|
| 5,044,016 | A * | 9/1991 | Coombs | 2/414 |
| 5,467,485 | A * | 11/1995 | Casartelli | 2/421 |
| 5,555,569 | A * | 9/1996 | Lane | 2/424 |
| 5,898,949 | A * | 5/1999 | Barthold et al. | 2/416 |
| 6,081,931 | A * | 7/2000 | Burns et al. | 2/411 |
| 7,698,750 | B2 * | 4/2010 | Bullock | 2/412 |

* cited by examiner

*Primary Examiner* — Gary L Welch
*Assistant Examiner* — Andrew W Collins
(74) *Attorney, Agent, or Firm* — Rosenberg, Klein & Lee

(57) ABSTRACT

A fixing structure for safety helmet fastening strap, including a frame body mounted under a bottom of a helmet shell. The frame body has multiple fixing seats each of which is formed with a passage and an opening through which a fastening strap can pass. The fixing seat has arms extending from the fixing seat. The fixing seats are securely connected with the frame body with better load capability. Accordingly, the fixing seats can bear the extrusion force of the injection molded foam material without deflection or displacement. The helmet shell, the frame body and the fixing seats are bonded with a foam material filler to together form an integrated body. The arms of the fixing seats help the fixing seats and the frame body to hold the foam material filler.

39 Claims, 6 Drawing Sheets

FIXING STRUCTURE FOR SAFETY HELMET FASTENING STRAP

BACKGROUND OF THE INVENTION

The present invention related to a fixing structure for safety helmet fastening strap, including a frame body mounted under a bottom of a helmet shell. The frame body has multiple fixing seats, which are securely connected with the frame body. The helmet shell, the frame body and the fixing seats are bonded with a foam material filler to together form an integrated body. The fixing seats can bear the extrusion force of the injection molded foam material without deflection or displacement.

A conventional safety helmet, such as a bicycle safety helmet or a horse-riding safety helmet, has a plastic shell and a foam material enclosed in the plastic shell. The plastic shell is airtight held in a vacuum mold and the foam material is injected into the vacuum mold to fill into the shell. Then, through a heating process, the plastic shell encloses the foam material to form the safety helmet. The conventional safety helmet is equipped with a fastening strap for fixing the safety helmet on a user's head. According to the foresaid safety helmet, the buckle ring has a projecting edge, a pinhole and a strap exit. After the buckle ring is placed into a mold, a foam material is injected into the mold to fill into the plastic shell of the safety helmet. At this time, the buckle ring is integrally bonded with the foam material. A stopper pin is transversely passed through the fastening strap and then the fastening strap is pulled out from the exit with the stopper pin engaged in the pinhole. The hidden buckle ring will not directly protrude from the bottom of the safety helmet as a conventional lug-type buckle ring. Therefore, the buckle ring is not likely to break off or abrade a wearer's face.

It is difficult to manufacture the above safety helmet. This is because before the foam material is injected, the plastic shell is separated from the buckle ring. Therefore, it is hard to retain the buckle ring in a set position in the mold. In general, a temporary fixing means is used to retain the buckle ring in the set position. However, the temporary fixing means is unreliable. When injecting the foam material into the mold, the extrusion force of the injected foam material often makes the buckle ring displace or deflect from its true position. As a result, after the shell and the buckle ring are bonded with the foam material to form the safety helmet, the safety helmet may have defects. The fastening strap may fail to connect with the buckle ring smoothly. Consequently, a wearer may feel uncomfortable when wearing such defective safety helmet or even can hardly wear such safety helmet stably.

In some cases, after the plastic shell and buckle ring are placed into the mold, a fixing mechanism or a clamping means is used to firmly retain the buckle ring in a set position without interfering with or obstructing the foam material injection molding process. Under such circumstance, the buckle ring is able to bear the extrusion force of the injected foam material. However, such arrangement leads to increased mold design cost and manufacturing cost.

There is another important topic in this field to consider. The buckle rings are independently bonded with the foam material. Therefore, an individual buckle ring is likely to disconnect from the foam material under sudden external force. That is, the buckle rings bonded with the foam material cannot share the external force to distribute the external force to the respective buckle rings.

FIG. 1 is a perspective view of another type of conventional safety helmet, showing how the fastening strap is assembled with the shell of the safety helmet. The plastic shell 70 is bonded with the foam material filler 80 with some holes 75 reserved. In practice, a fastening strap 90 is conducted through each hole 75 by an operator to pass through a buckle head 91. Then a tail end section 92 of the fastening strap 90 is sewn to loop the buckle head 91. Then the fastening strap 90 is pulled to engage the buckle head 91 in the hole 75. According to the above arrangement, the fastening straps 90 are passed through the foam material filler 80 and the plastic shell 70 with the buckle heads 91 engaged in the holes 75 formed through both the foam material filler 80 and the plastic shell 70. Therefore, the buckle heads 91 have sufficient load capability to bear the sudden external force.

However, as known by those skilled in this field, there are still some shortcomings existing in the manufacturing process of such structure. For example, the sewing operation is performed after the tail end section 92 of the fastening strap 90 is passed through the hole 75 and the buckle head 91. Therefore, it is necessary to place the entire safety helmet on a sewing table for the sewing operation. In this case, the safety helmet often obstructs the sewing operation and leads to troubles in the sewing operation or even danger of sewing workers. As a result, the tail end section 92 of the fastening strap 90 is often sewn with defects. Moreover, according to the above arrangement, when a wearer wears the safety helmet, the fastening strap 90 often abrades the face of the wearer. Also, the buckle heads 91 are exposed to outer side of the safety helmet. This deteriorates the appearance of the safety helmet.

Therefore, the following should be taken into consideration when designing the arrangement of the fastening strap and the safety helmet shell as well as the foam material filler:

1. The fastening strap fixing seats or the buckle rings should be securely fixed in the set positions without using any other additional fixing mechanism or clamping means to bear the extrusion force of the injection molded foam material without deflection or displacement.
2. The fastening strap should be fixed with the plastic shell and the foam material filler without affecting the appearance of the safety helmet or abrading the face of a wearer. Also, the sewing operation should be easy to perform.
3. All the fixing seats or the buckle rings should be securely connected with the plastic shell and bonded with the foam material filler to have better load capability. In this case, when an external force is suddenly applied to any of the fixing seats or buckle rings, the fixing seats or buckle rings can together bear the external force without breakage or detachment of any individual fixing seat or buckle ring as in the prior art.

SUMMARY OF THE INVENTION

It is therefore a primary object of the present invention to provide a fixing structure for safety helmet fastening strap, including a frame body mounted under a bottom of a helmet shell. The frame body has multiple fixing seats each of which is formed with a passage and an opening through which a fastening strap can pass. The fixing seat has arms extending from the fixing seat. The fixing seats are securely connected with the frame body with better load capability. The helmet shell, the frame body and the fixing seats are bonded with a foam material filler to together form an integrated body. The fixing seats can bear the extrusion force of the injection molded foam material without deflection or displacement.

According to the above object, the frame body of the fastening strap fixing structure of the present invention has a substantially U-shaped cross-section and is defined with an inner wall, a bottom wall and an outer wall. Multiple recesses are formed on the inner wall. The fixing seats are securely truly insert-connected in the recesses in set positions to bear the extrusion force of the injection molded foam material without deflection or displacement.

Each recess has two sides formed with rib sections respectively. Two sides of the fixing seat are formed with channel rails corresponding to the rib sections. When the fixing seat is inserted into the recess, the rib sections are inlaid in the channel rails of the fixing seat. The rib sections and the channel rails extend along a transverse reference x-axis.

Each of the arms of the fixing seat has multiple ribs defining multiple hollows. Accordingly, each arm has a hollow geometrical configuration. The foam material filler is filled in all the hollows between the ribs to wrap all the ribs and arms. Accordingly, the arms help the fixing seat and the frame body to bond with the foam material filler.

The plastic shell, the frame body and the fixing seats are bonded with the foam material filler to together form an integrated body. Therefore, when an external force is suddenly applied to any of the fixing seats and the fastening strap, the frame body and all the fixing seats will together bear the external force. Accordingly, the fixing seat has better load capability than the conventional device.

The present invention can be best understood through the following description and accompanying drawings wherein:

DETAILED DESCRIPTION OF THE PREFERRED EMBODIMENTS

Figure 1:
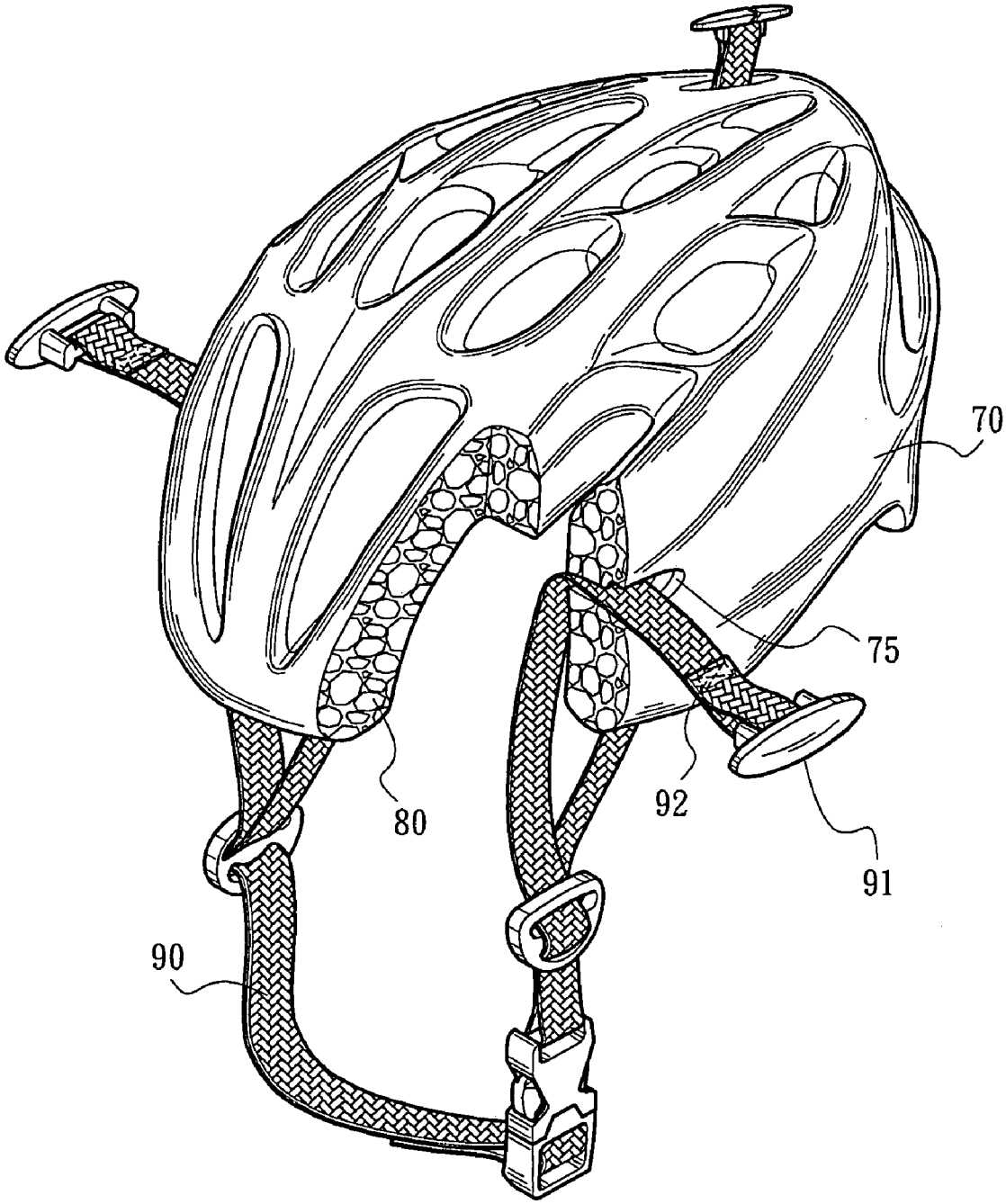
Fig. 1 PRIOR ART
FIG. 1 is a perspective partially sectional view of a conventional safety helmet, showing how the fastening strap is assembled with the shell of the safety helmet.
Figure 2:
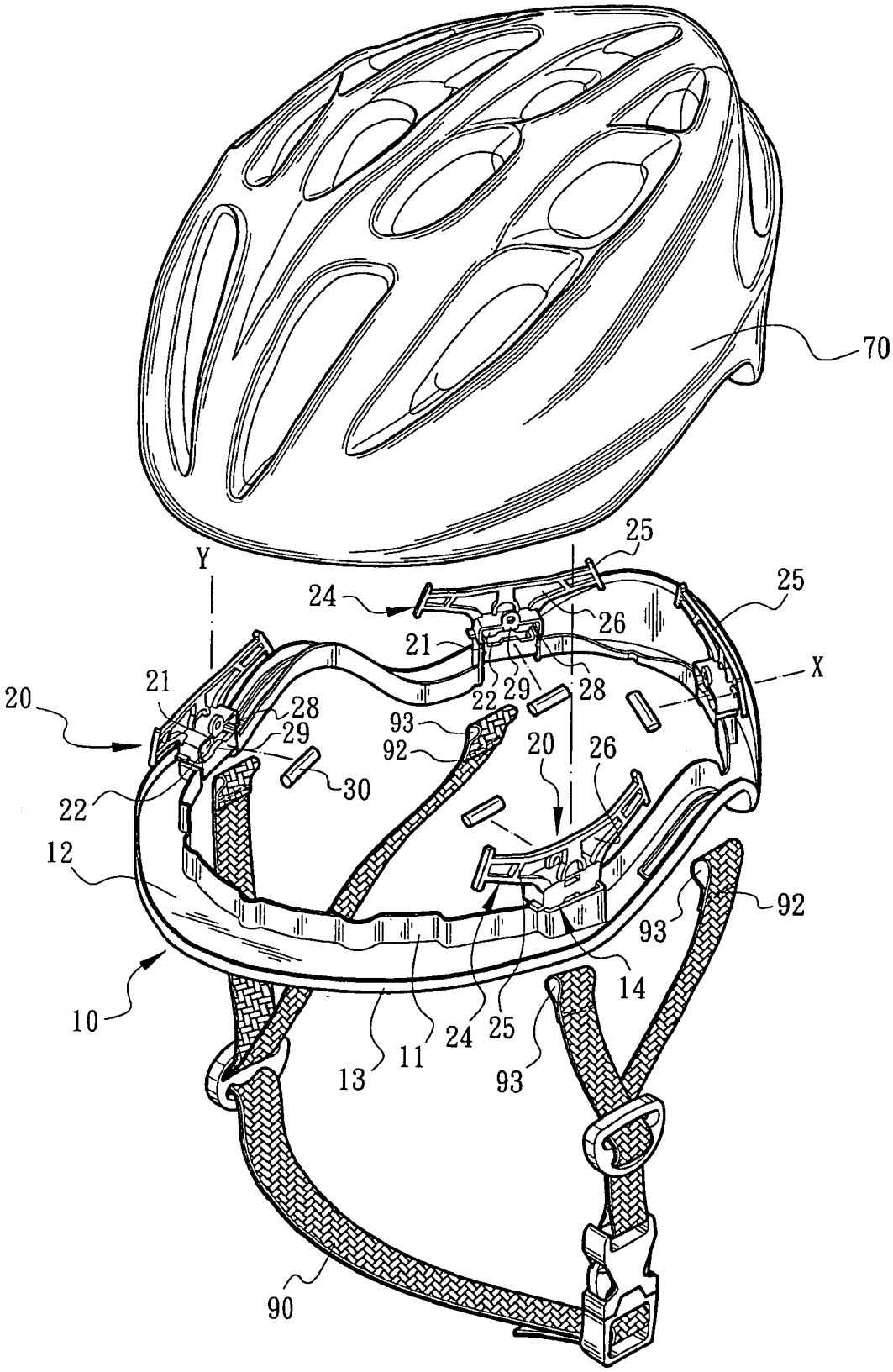
FIG. 2 is a perspective view of the present invention, showing the frame body, the fixing seats, the shell and the fastening strap thereof.
Figure 3:
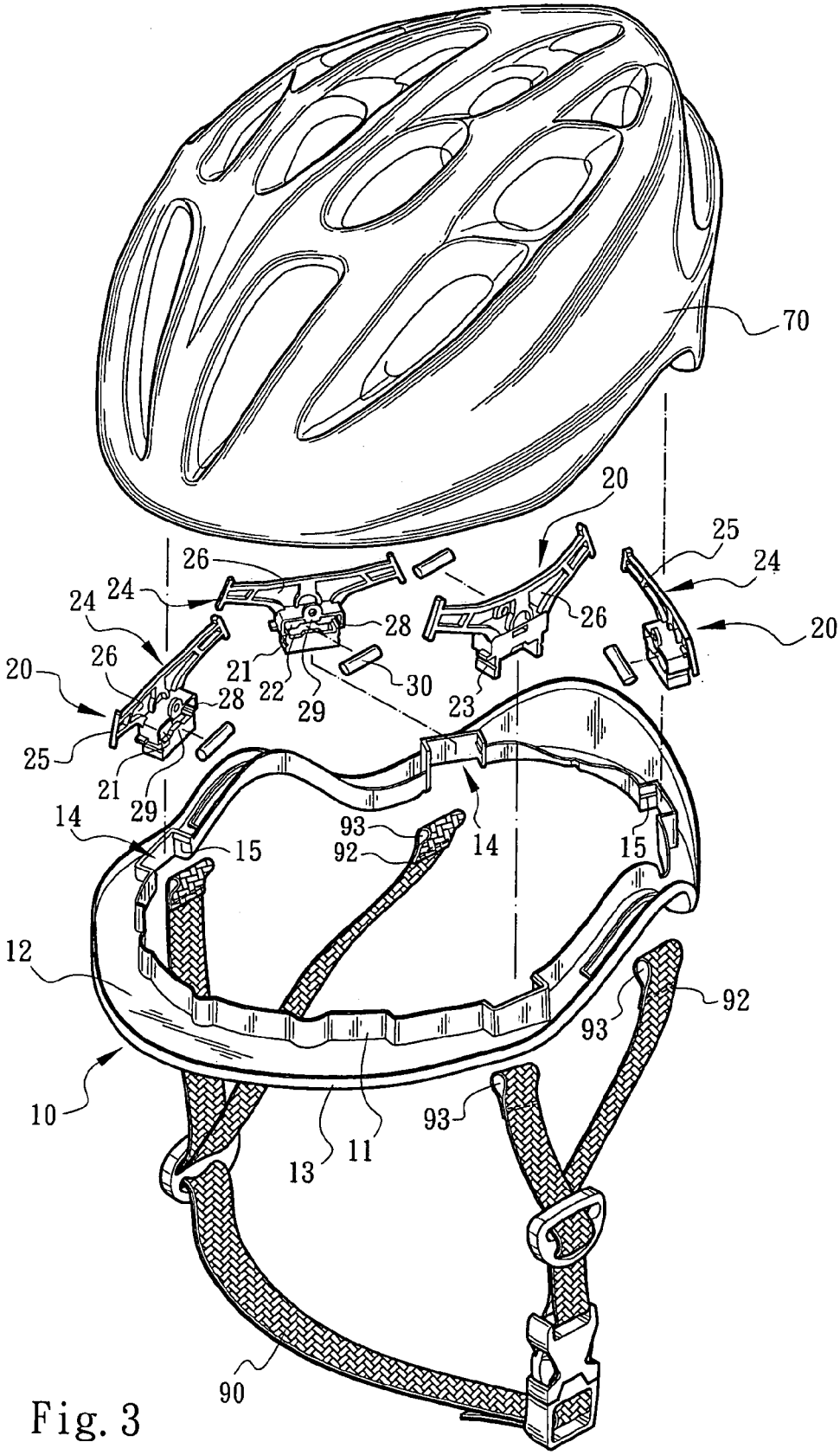
FIG. 3 is a perspective exploded view according to FIG. 2.

Please refer to FIGS. 2 and 3. According to a preferred embodiment, the fixing structure for safety helmet fastening strap of the present invention is applied to a bicycle safety helmet. The fixing structure includes a frame body 10 mounted under the bottom of a helmet shell 70. The frame body 10 has a substantially annular configuration adapted to that of the bottom of the helmet shell 70. In this embodiment, the frame body 10 has a substantially U-shaped cross-section and is defined with an inner wall 11, a bottom wall 12 and an outer wall 13. The inner wall 11 is formed with multiple recesses 14 arranged at intervals for receiving multiple fixing seats 20 as shown in FIG. 2. In a modified embodiment, the recesses 14 can be alternatively formed on the outer wall 13.

Figure 4:
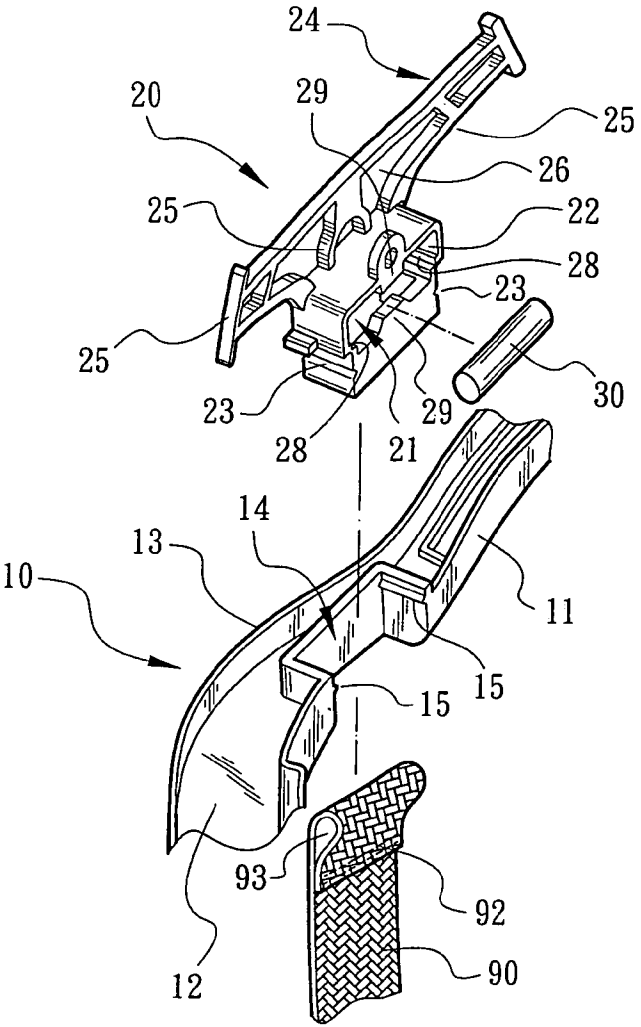
FIG. 4 is a partially enlarged view according to FIG. 3, showing the frame body, the fixing seat and the fastening strap of the present invention.

Please now refer to FIGS. 3 and 4. Each recess 14 has two sides formed with rib sections 15 respectively. In this embodiment, the rib sections 15 extend along a transverse reference x-axis to insert-connect with a fixing seat 20. The fixing seat 20 is formed with a passage 21 and an opening 22 through which a tail end section 92 of the fastening strap 90 is passed. The tail end section 92 is looped to define a bore 93. Shoulder sections 28 are formed on two sides of the passage 21 for stopping an insertion pin 30. (This will be further described hereinafter.) Two sides of the fixing seat 20 are formed with channel rails 23 corresponding to the rib sections 15 of two sides of the recess 14. The channel rails 23 extend along the transverse reference x-axis. The fixing seat 20 can be fitted into the recess 14 with the rib sections 15 of the recess 14 inserted into the channel rails 23. Accordingly, the fixing seat 20 can be securely fixed in a set position (the recess 14) of the frame body 10 to bear the extrusion force of the injection molded foam material without deflection or displacement.

Referring to FIGS. 3 and 4, the tail end section 92 of the fastening strap 90 is previously folded over itself and sewn to form a loop defining the bore 93. In contrast, in the prior art, the entire safety helmet must be placed on a sewing table for the sewing operation. Such process is troublesome and dangerous to workers. Moreover, in the prior art, the sewn section of the fastening strap is likely to have defects. The present invention overcomes all the problems existing in the prior art.

According to a preferred embodiment, the fixing seat 20 has two arms extending from two sides of the fixing seat 20 to help the fixing seat 20 in holding the foam material filler 80. Each arm 24 has multiple ribs 25 defining multiple hollows 26. Accordingly, the arm 24 has a hollow geometrical configuration.

Figure 6:
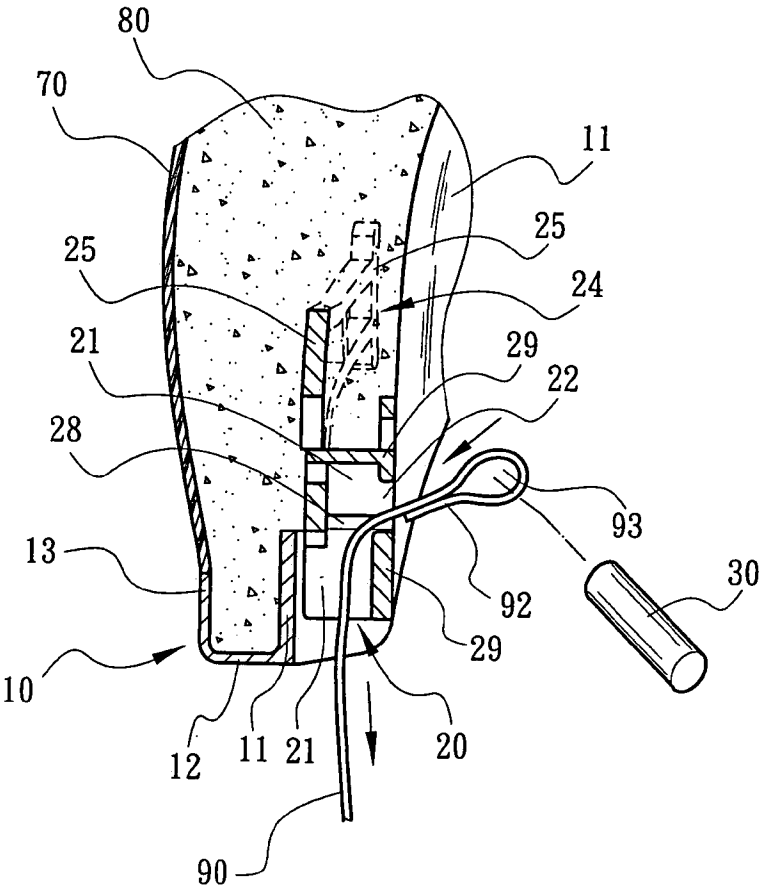
FIG. 6 is another sectional view of the present invention, showing that the fixing seat is connected with the frame body and bonded with the foam material filler, also showing how the fixing seat is connected with the fastening strap.
Figure 5:
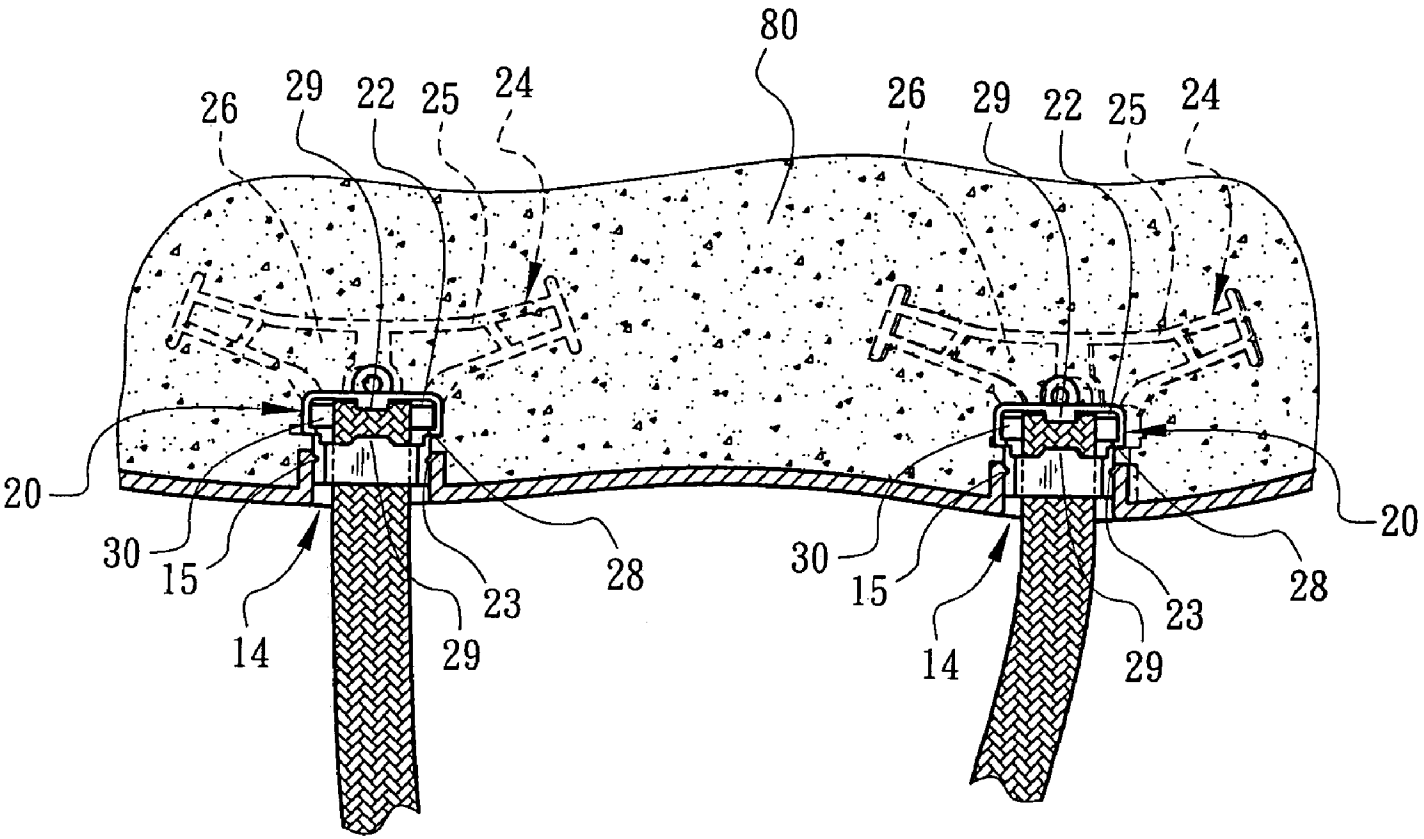
FIG. 5 is a sectional view of the present invention, showing that the fixing seat is connected with the frame body and bonded with the foam material filler, also showing how the fixing seat is connected with the fastening strap.

In this embodiment, the shell 70 and the frame body 10 are placed into a mold (such as a vacuum mold or an injection mold). The foam material filler 80 is heated, whereby the shell 70 and the frame body 10 encloses the foam material filler 80. Accordingly, the shell 70, the frame body 10 and the foam material filler 80 together form an integrated compact body as shown in FIGS. 5 and 6. The foam material filler 80 encloses a periphery of the fixing seat 20 with the passage 21 and the opening 22 keeping open. FIGS. 5 and 6 show that the foam material filler 80 is filled in all the hollows 26 between the ribs 25 to wrap all the ribs 25 and arms 24. Accordingly, the arms 24 help the fixing seat 20 and the frame body 10 to bond with the foam material filler 80. Therefore, when an external force is suddenly applied to any of the fixing seats 20 and the fastening strap 90, the frame body 10 and all the fixing seats 20 will together bear the external force. Accordingly, the fixing seat 20 has better load capability than the conventional device.

Figure 7:
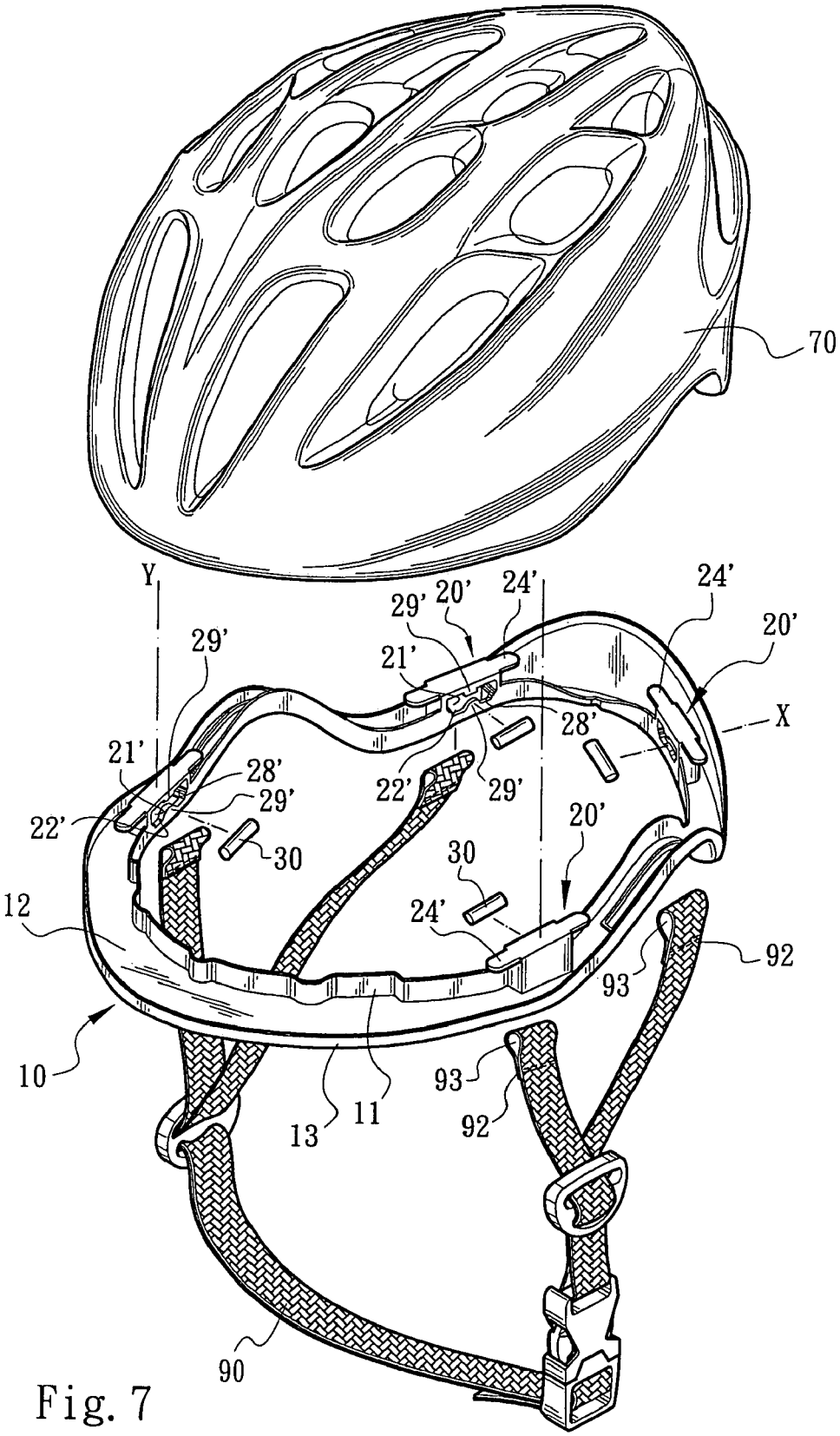
FIG. 7 is a perspective view of another embodiment of the present invention, showing another type of fixing seats and frame body.

The connection between the fastening strap 90 and the fixing seat 20 is shown in FIG. 6 as indicated by the arrows. The tail end section 92 of the fastening strap 90 is conducted into the passage 21 of the fixing seat 20 from a lower side thereof and then pulled out of the opening 22. Then the insertion pin 30 is inserted into the bore 93 of the tail end section 92. Then the tail end section 92 with the insertion pin 30 is pulled into the passage 21. At this time, the insertion pin 30 is stopped by the shoulder sections 28 of two sides of the passage 21. In this case, due to the restriction of the insertion pin 30 received in the bore 93, the tail end section 92 of the fastening strap 90 is held in the passage 21 to complete the assembling process of the fastening strap 90 and the safety helmet. According to a preferred embodiment, at least one stopper block 29 is formed at the opening 22 of the fixing seat 20. After the insertion pin 30 is pressed into the passage 21, the stopper block 29 serves to prevent the insertion pin 30 from being extracted out of the passage 21. Only when a great force exceeding the stopping force of the stopper block 29 is applied to the insertion pin 30, the insertion pin 30 can be forcedly extracted out of the passage 21 and the opening 22. FIG. 7 shows another embodiment of the present invention, in which the fixing seats 20' are integrally formed with the frame body 10. The fixing seats 20' are disposed on the inner wall 11 of the frame body 10. Each fixing seat 20' has a passage 21', an opening 22' and a stopper block 29' formed at the opening 22'. Shoulder sections 28' are formed in the passage 21' for stopping an insertion pin 30. The fixing seat 20' has two arms 24' extending from two sides of the fixing seat 20' to help the fixing seat 20' in holding the foam material filler 80. Each arm 24' has a geometrical configuration and extends by an angle different from that of the above embodiment. Moreover, in this embodiment, the arm 24' is a solid body (without any hollow).

According to the above arrangement, the fixing seats 20, 20' can be detachably assembled with the frame body 10 or integrally connected with the frame body 10 with optimal fixing effect. The fixing seats 20, 20' are able to bear the extrusion force of the injection molded foam material without deflection or displacement. Alternatively, the fixing seats 20 can be detachably assembled with the frame body 10 with the fixing seats 20' integrally connected with the frame body 10.

According to the aforesaid, the fixing structure for safety helmet fastening strap of the present invention has the following advantages:

1. The fastening strap fixing seats 20 can be securely fixed in the set positions without using any other additional fixing mechanism or clamping means. The fixing seats 20 can be integrally connected with the frame body 10 to bear the extrusion force of the injection molded foam material without deflection or displacement. In contrast, in the conventional device, the fixing seat or buckle ring can hardly bear the extrusion force of the injection molded foam material and is likely to deflect or displace.
2. In the present invention, the fixing seats 20 are fixed with the frame body 10 and the shell 70 and bonded with the foam material filler 80 without being exposed to outer side. In contrast, in the conventional device, the buckle head 91 is exposed to outer side to deteriorate the appearance of the safety helmet as a whole. Moreover, the frame body 10 holds the bottom of the shell 70 and the bottom of the foam material filler 80 to beautify the appearance of the safety helmet. Also, this makes the fastening strap 90 connected under the bottom of the safety helmet without abrading a user's face when wearing the safety helmet. Furthermore, the fixing structure for safety helmet fastening strap of the present invention makes it easier for a worker to sew the tail end section 92 of the fastening strap 90.
3. All the fixing seats 20 are securely connected with the frame body 10 to form an integrated body. Also, the arms 24 and the fixing seats 20 are totally wrapped with the foam material filler 80. When an external force is suddenly applied to any of the fixing seats 20 and the fastening strap 90, the frame body 10 and all the fixing seats 20 will together bear the external force. Accordingly, the fixing seat 20 has better load capability than the conventional device. The foam material filler 80 is filled in all the hollows 26 between the ribs 25 to wrap all the ribs 25 and arms 24. Accordingly, the arms 24 help the fixing seat 20 and the frame body 10 to bond with the foam material filler 80.

The above embodiments are only used to illustrate the present invention, not intended to limit the scope thereof. Many modifications of the above embodiments can be made without departing from the spirit of the present invention.

What is claimed is:

1. A fixing structure for safety helmet fastening strap, comprising a frame body mounted under a bottom of a helmet shell, fixing seats being disposed on the frame body, each fixing seat being formed with a passage and an opening through which a fastening strap can pass, the fixing seat having arms formed on the fixing seat and extending from the fixing seat into the shell wherein the frame body is formed with multiple recesses, which are left and right symmetrically arranged at intervals for receiving multiple fixing seats, and each recess has two sides formed with rib sections respectively, two sides of the fixing seat being formed with channel rails corresponding to the rib sections.

2. The fixing structure for safety helmet fastening strap as claimed in claim 1, wherein the frame body has a substantially U-shaped cross-section and is defined with an inner wall, a bottom wall and an outer wall, the recesses being formed on the inner wall.

3. The fixing structure for safety helmet fastening strap as claimed in claim 1, wherein the rib sections and the channel rails extend along a transverse reference x-axis.

4. The fixing structure for safety helmet fastening strap as claimed in claim 2, wherein the rib sections and the channel rails extend along a transverse reference x-axis.

5. The fixing structure for safety helmet fastening strap as claimed in claim 1, wherein shoulder sections are formed in the passage of the fixing seat for stopping an insertion pin.

6. The fixing structure for safety helmet fastening strap as claimed in claim 2, wherein shoulder sections are formed in the passage of the fixing seat for stopping an insertion pin.

7. The fixing structure for safety helmet fastening strap as claimed in claim 1, wherein the arms extend from two sides of the fixing seat, each arm having multiple ribs defining multiple hollows, whereby the arm has a hollow configuration.

8. The fixing structure for safety helmet fastening strap as claimed in claim 2, wherein the arms extend from two sides of the fixing seat, each arm having multiple ribs defining multiple hollows, whereby the arm has a hollow configuration.

9. The fixing structure for safety helmet fastening strap as claimed in claim 5, wherein the arms extend from two sides of the fixing seat, each arm having multiple ribs defining multiple hollows, whereby the arm has a hollow configuration.

10. The fixing structure for safety helmet fastening strap as claimed in claim 1, wherein the frame body, the fixing seats, the shell and a foam material filler are bonded with each other to together form an integrated body, the foam material filler being filled in the shell and the frame body to at least enclose peripheries of the fixing seats with the passages and the openings keeping open.

11. The fixing structure for safety helmet fastening strap as claimed in claim 2, wherein the frame body, the fixing seats, the shell and a foam material filler are bonded with each other to together form an integrated body, the foam material filler being filled in the shell and the frame body to at least enclose peripheries of the fixing seats with the passages and the openings keeping open.

12. The fixing structure for safety helmet fastening strap as claimed in claim 5, wherein the frame body, the fixing seats, the shell and a foam material filler are bonded with each other to together form an integrated body, the foam material filler being filled in the shell and the frame body to at least enclose peripheries of the fixing seats with the passages and the openings keeping open.

13. The fixing structure for safety helmet fastening strap as claimed in claim 7, wherein the frame body, the fixing seats, the shell and a foam material filler are bonded with each other to together form an integrated body, the foam material filler being filled in the shell and the frame body to at least enclose peripheries of the fixing seats with the passages and the openings keeping open.

14. The fixing structure for safety helmet fastening strap as claimed in claim 1, wherein at least one stopper block is formed at the opening of the fixing seat for preventing an insertion pin from being extracted out of the passage.

15. The fixing structure for safety helmet fastening strap as claimed in claim 2, wherein at least one stopper block is formed at the opening of the fixing seat for preventing an insertion pin from being extracted out of the passage.

16. The fixing structure for safety helmet fastening strap as claimed in claim 5, wherein at least one stopper block is formed at the opening of the fixing seat for preventing the insertion pin from being extracted out of the passage.

17. The fixing structure for safety helmet fastening strap as claimed in claim 7, wherein at least one stopper block is formed at the opening of the fixing seat for preventing an insertion pin from being extracted out of the passage.

18. The fixing structure for safety helmet fastening strap as claimed in claim 10, wherein at least one stopper block is formed at the opening of the fixing seat for preventing an insertion pin from being extracted out of the passage.

19. The fixing structure for safety helmet fastening strap as claimed in claim 1, wherein the fixing seats are integrally formed on the frame body.

20. The fixing structure for safety helmet fastening strap as claimed in claim 19, wherein shoulder sections are formed in the passage of the fixing seat for stopping an insertion pin.

21. The fixing structure for safety helmet fastening strap as claimed in claim 19, wherein the arms extend from two sides of the fixing seat, each arm having multiple ribs defining multiple hollows, whereby the arm has a hollow configuration.

22. The fixing structure for safety helmet fastening strap as claimed in claim 20, wherein the arms extend from two sides of the fixing seat, each arm having multiple ribs defining multiple hollows, whereby the arm has a hollow configuration.

23. The fixing structure for safety helmet fastening strap as claimed in claim 19, wherein the frame body, the fixing seats, the shell and a foam material filler are bonded with each other to together form an integrated body, the foam material filler being filled in the shell and the frame body to at least enclose peripheries of the fixing seats with the passages and the openings keeping open.

24. The fixing structure for safety helmet fastening strap as claimed in claim 20, wherein the frame body, the fixing seats, the shell and a foam material filler are bonded with each other to together form an integrated body, the foam material filler being filled in the shell and the frame body to at least enclose peripheries of the fixing seats with the passages and the openings keeping open.

25. The fixing structure for safety helmet fastening strap as claimed in claim 21, wherein the frame body, the fixing seats, the shell and a foam material filler are bonded with each other to together form an integrated body, the foam material filler being filled in the shell and the frame body to at least enclose peripheries of the fixing seats with the passages and the openings keeping open.

26. The fixing structure for safety helmet fastening strap as claimed in claim 22, wherein the frame body, the fixing seats, the shell and a foam material filler are bonded with each other to together form an integrated body, the foam material filler being filled in the shell and the frame body to at least enclose peripheries of the fixing seats with the passages and the openings keeping open.

27. The fixing structure for safety helmet fastening strap as claimed in claim 19, wherein at least one stopper block is formed at the opening of the fixing seat for preventing an insertion pin from being extracted out of the passage.

28. The fixing structure for safety helmet fastening strap as claimed in claim 20, wherein at least one stopper block is formed at the opening of the fixing seat for preventing an insertion pin from being extracted out of the passage.

29. The fixing structure for safety helmet fastening strap as claimed in claim 21, wherein at least one stopper block is formed at the opening of the fixing seat for preventing an insertion pin from being extracted out of the passage.

30. The fixing structure for safety helmet fastening strap as claimed in claim 23, wherein at least one stopper block is formed at the opening of the fixing seat for preventing an insertion pin from being extracted out of the passage.

31. The fixing structure for safety helmet fastening strap as claimed in claim 1, wherein the arms are solid bodies.

32. The fixing structure for safety helmet fastening strap as claimed in claim 2, wherein the arms are solid bodies.

33. The fixing structure for safety helmet fastening strap as claimed in claim 5, wherein the arms are solid bodies.

34. The fixing structure for safety helmet fastening strap as claimed in claim 10, wherein the arms are solid bodies.

35. The fixing structure for safety helmet fastening strap as claimed in claim 14, wherein the arms are solid bodies.

36. The fixing structure for safety helmet fastening strap as claimed in claim 19, wherein the arms are solid bodies.

37. The fixing structure for safety helmet fastening strap as claimed in claim 21, wherein the arms are solid bodies.

38. The fixing structure for safety helmet fastening strap as claimed in claim 23, wherein the arms are solid bodies.

39. The fixing structure for safety helmet fastening strap as claimed in claim 27, wherein the arms are solid bodies.

* * * * *